US006836082B2

(12) United States Patent
Buij et al.

(10) Patent No.: US 6,836,082 B2
(45) Date of Patent: Dec. 28, 2004

(54) BALLAST AND METHOD OF FEEDING A FLUORESCENT LAMP

(75) Inventors: Arnold Willem Buij, Eindhoven (NL); Marcel Beij, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 134 days.

(21) Appl. No.: 10/203,078

(22) PCT Filed: Dec. 12, 2001

(86) PCT No.: PCT/IB01/02544

§ 371 (c)(1),
(2), (4) Date: Aug. 6, 2002

(87) PCT Pub. No.: WO02/49398

PCT Pub. Date: Jun. 20, 2002

(65) Prior Publication Data

US 2003/0102816 A1 Jun. 5, 2003

(30) Foreign Application Priority Data

Dec. 15, 2000 (EP) ..... 00204638

(51) Int. Cl.[7] ..... G05F 1/00
(52) U.S. Cl. ..... 315/308; 315/224; 315/391
(58) Field of Search ..... 315/224, DIG. 4, 315/209 R, 271, 307, 308, 225, DIG. 5; G05F 1/00

(56) References Cited

U.S. PATENT DOCUMENTS

| | | | | | |
|---|---|---|---|---|---|
| 4,896,077 | A | * | 1/1990 | Dodd et al. | 315/289 |
| 5,680,015 | A | | 10/1997 | Bernitz et al. | 315/291 |
| 5,808,597 | A | * | 9/1998 | Onitsuka et al. | 345/102 |
| 5,910,713 | A | * | 6/1999 | Nishi et al. | 315/308 |
| 5,952,793 | A | * | 9/1999 | Nishi et al. | 315/307 |
| 6,081,077 | A | * | 6/2000 | Canova et al. | 315/307 |

FOREIGN PATENT DOCUMENTS

| | | | |
|---|---|---|---|
| EP | 0731437 A2 | 9/1996 | G09G/3/34 |
| EP | 0889675 A1 | 1/1999 | H05B/41/00 |
| EP | 1003357 A1 | 5/2000 | H05B/41/292 |

* cited by examiner

*Primary Examiner*—Don Wong
*Assistant Examiner*—Trinh Vo Dinh

(57) ABSTRACT

A ballast (1) for feeding a fluorescent lamp (9), comprising power supply means (2) for supplying a stabilised power to the lamp (9), dimming means (3) for adjusting said power, a voltmeter (5) which is capable of measuring the voltage across the lamp (9), comparator means (6) which are capable of comparing the measured voltage with a threshold value, contact breaker means (7) which are capable of interrupting the power supply to the lamp (9) when the measured voltage is higher than the threshold value for a predetermined period of time, as well as adjusting means (4) which are capable of adjusting the magnitude of the threshold value in dependence on the power.

11 Claims, 1 Drawing Sheet

BALLAST AND METHOD OF FEEDING A FLUORESCENT LAMP

Figure 1:
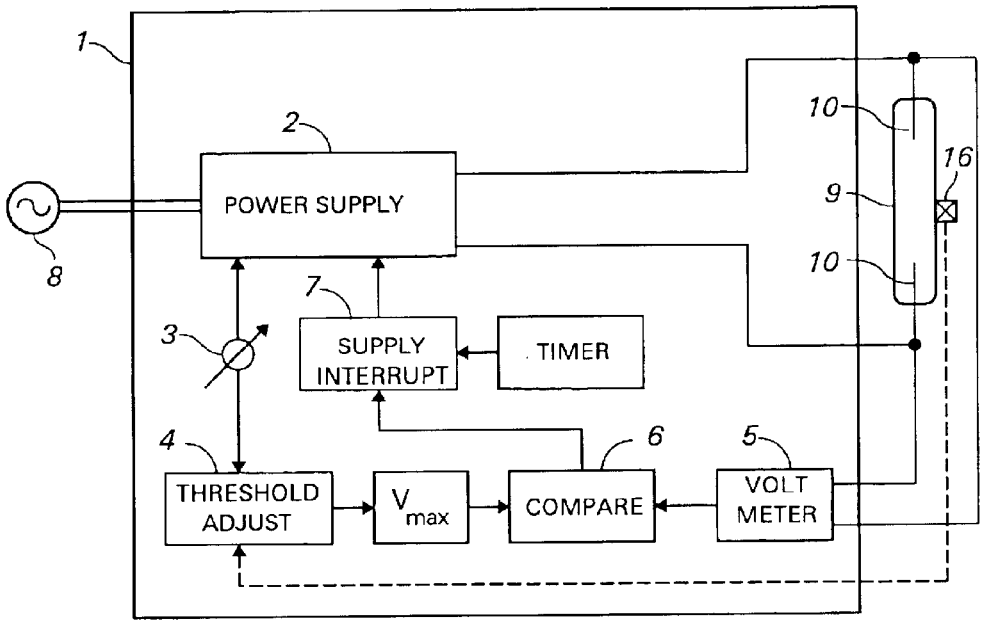

The invention relates to a ballast for feeding a fluorescent lamp, comprising supply means to supply a stabilised power to the lamp, dimming means for adjusting the power, a voltmeter which can measure the voltage across the lamp, voltage comparator means which can compare the measured voltage with a threshold, and supply interruption means which can interrupt the power supply to the lamp if the measured voltage exceeds the threshold during a defined delay period.

Such a ballast is described in American patent U.S. Pat. No. 5,043,635. The life of fluorescent lamps, such as TL-lamps, is determined in most cases by wear of the lamp electrodes. Specifically, the emitter powder applied to the electrodes during lamp manufacture will eventually sputter from the electrodes and evaporate. Consequently, the properties of the lamp deteriorate and the light output is less than optimal. Furthermore, the voltage across the lamp increases greatly due to the increased emission potential of the electrodes. This may lead to hazardous situations such as an unacceptable temperature rise of the electrodes, or even melting of the electrodes or immediately adjacent parts. A known method to prevent this situation is to continuously measure the voltage across the lamp and if the voltage exceeds a defined threshold for some time it is assumed that the lamp has reached the end of its life, after which the power supply to the lamp is automatically interrupted. The reason that the measured voltage should exceed the threshold for some time before the lamp is switched off is that the measured signal contains transients, specifically when measurements are made using an AD converter, during which it is desirable for the lamp to continue operating.

Such a method generally provides satisfactory results. However, if the lamp is provided with dimming means to adjust the power flowing through the lamp, a hazardous situation may still arise. This is because the normal operating voltage across the electrodes depends on the power setting and shows a substantially inversely proportional relationship. Thus, the voltage is high at a low power, and falls as the power increases. Thus, for fluorescent lamps provided with dimming means said threshold should be set above the maximum voltage which can occur during normal operation at a low power. Consequently, when the lamp is operated at full power, the threshold will be far above the normal operating voltage. It will therefore take longer for the voltage to exceed the threshold due to electrode wear, as a result of which the lamp may still be overheated.

This invention aims to provide a low-cost, effective, user-friendly and/or safe ballast which is switched off in time when the electrodes are worn out, even if the ballast is provided with dimming means.

To this end, the ballast also includes adjusting means capable of adjusting the magnitude of the threshold in dependence on the power supplied to the lamp, preferably in dependence on the power set by the dimming means or the actually measured power. For example, the threshold could be a fixed percentage above the normal operating voltage for any set power. Consequently, the difference between the normal operating voltage and the threshold will be acceptably low at any power, so that the lamp is switched off in time and hazardous situations are avoided.

As the voltage across the electrodes is furthermore dependent on the temperature of the electrodes in particular, preferably the adjusting means shall also be connected to a temperature sensor which preferably measures the ambient temperature or the temperature of a lamp component, in which case the adjusting means also adjust the threshold in dependence on the measured temperature.

Furthermore, the voltage across the electrodes depends on the type of lamp, and preferably the adjusting means shall therefore adjust the threshold in dependence on the type of fluorescent lamp powered by the ballast. Preferably, the ballast and/or the luninaire in which the lamp is fitted shall therefore contain detecting means to determine the type of lamp.

Preferably, the adjusting means shall calculate the threshold as a function of the set or measured power or the adjusting means shall include storage means in which combinations of powers and the associated thresholds are stored, for example in the form of a table.

The present invention can be implemented efficiently through the use of a microprocessor in the ballast. This makes it straightforward to also determine the delay time in dependence on the power, or the type of fluorescent lamp powered by the ballast, so that in every case the optimum lamp behaviour is obtained at the end of its life.

The present invention also relates to a method of feeding a fluorescent lamp in which the power set by the dimming means is supplied to the lamp, in which the voltage across the lamp is measured, the measured voltage is compared with a threshold, and the power supply to the lamp is interrupted if, during a defined delay period, the measured voltage is higher than the threshold, with the magnitude of the threshold being adjusted in dependence on the power.

These and other aspects of the invention are apparent from and will be elucidated, by way of non-limiting example, with reference to the embodiment(s) described hereinafter.

Figure 2:
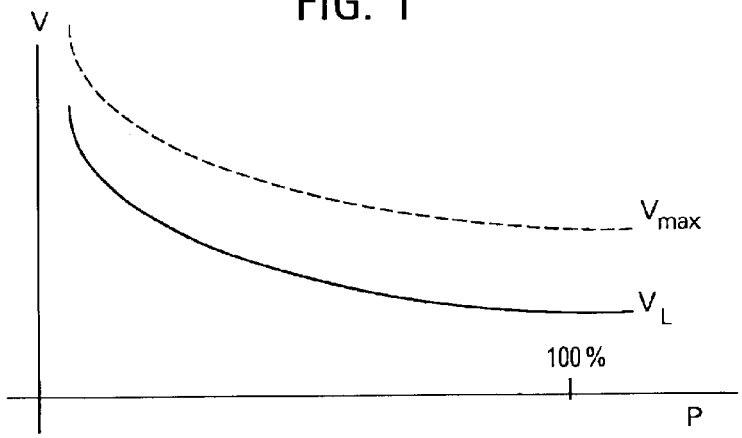

In the drawings:

FIG. 1 schematically shows a ballast in accordance with the present invention; and FIG. 2 shows a graph of the normal operating voltage across a fluorescent lamp as well as the threshold of the ballast adjusted in accordance with the invention, as a function of the power through the lamp.

Figure 3:
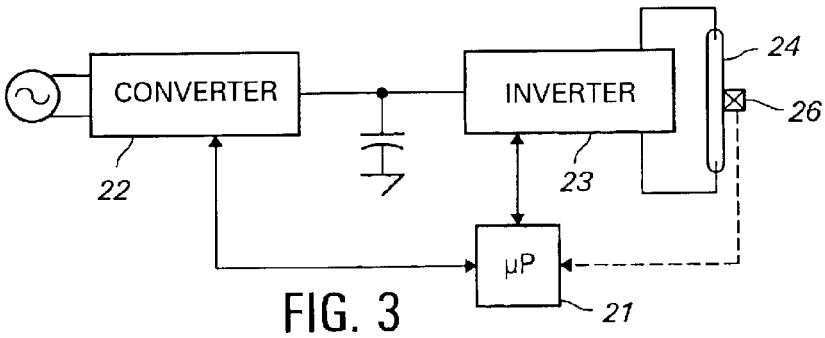

FIG. 3 schematically shows ballast controlled by a suitably programmed microprocessor.

As shown in FIG. 1, ballast 1 comprises power supply means 2, dimming means 3, threshold adjustment means 4, a voltmeter 5, voltage comparator means 6, and supply interruption means 7. The ballast 1 is connected to the mains 8, and a fluorescent lamp 9 is connected to the ballast 1.

The power supply means 2 is primarily a power supply for a fluorescent lamp according to the state of the art, which ensures that the lamp is correctly started and then fed in a stable manner. It is known that when approaching the end of the life of the lamp 9, when the electrodes 10 of the lamp 9 have worn out and specifically when the emitter powder on those electrodes 10 has disappeared, the voltage across the electrodes 10 rises greatly. This could lead to overheating of the lamp and eventually melting the electrodes, the glass of the lamp, or the luminaire in which the lamp is fitted. To prevent such a hazardous and undesirable situation, it is known to provide the ballast 1 with a voltmeter 5 which measures the voltage $V_1$ across the lamp and a voltage comparator means 6 which compares the measured voltage $V_1$ with a defined threshold $V_{max}$. The result of this comparison is read by supply interruption means 7. If the measured voltage $V_1$ exceeds $V_{max}$ during a delay time set by timer 12, the supply interruption means 7 will switch off power supply 2. The objective of the delay time is to ignore the effect of occasional short peak voltages across lamp 9 which may readily occur in a high frequency system such as this. If the supply is switched of in this way this is a signal that lamp 9 has reached the end of its life and that lamp 9 should be replaced.

It is also known to provide ballast 2 with dimming means 3 which can be used to adjust the power through the lamp 9, and thereby the light output. A problem associated with this is that because of the characteristics of the lamp 9 and the ballast 2, the voltage $V_1$ across the lamp is much higher at low power (P) than at full power, as shown in FIG. 2 by the solid line. Consequently, the threshold $V_{max}$ in such a system has to be adjusted to a value which is at least higher than the maximum voltage which occurs under normal operating conditions at this low power. Consequently, the difference between $V_{max}$ and $V_1$ at full power is so high that the supply interruption means only switches the ballast off at a large increase in $V_1$, in which event there is a risk of the lamp being damaged and/or hazardous situations arising.

The ballast 1 is therefore also provided with threshold adjusting means 4, connected to dimming means 3. The adjusting means 4 read the adjusted power (P) of the dimming means 3, and correspondingly adjust the threshold $V_{max}$ with which the lamp voltage $V_1$ is compared by the voltage comparator means 6. Consequently, the adjusting means 4 in this embodiment have access to a table in which this dependence is defined, as graphically shown by a dotted line in FIG. 2. It is also possible to define this dependence using a mathematical function. In this way it is accomplished that the threshold $V_{max}$ is not excessively higher than the normal operating voltage $V_1$ at any adjusted power, as a consequence of which the ballast is switched off in time.

In an alternative embodiment, the adjusting means 4 can adjust the threshold in dependence on the actual power supplied to the lamp 9, instead of the power set by dimming means 3.

As the lamp voltage $V_1$ also depends on the mercury vapour pressure which depends on the temperature of the wall of the lamp, in an alternative embodiment the adjusting means 4 are connected to optional temperature sensor 16 which preferably measures the lamp temperature but which in a simpler embodiment measures the ambient temperature near the lamp 9. In that case, the threshold $V_{max}$ is adjusted (partly) in dependence on the measured temperature.

Furthermore, lamp voltage $V_1$ depends on the type of lamp 9 connected to ballast 1. Therefore, in a further embodiment the adjusting means are connected to lamp detection means which automatically determine the type of lamp 9, or the lamp type can be selected manually. In that case, the treshold $V_{max}$ is adjusted (partly) in dependence on the lamp.

What is claimed is:

1. A ballast (1) for feeding a fluorescent lamp (9), comprising power supply means (2) to supply a stabilised power to the lamp (9), dimming means (3) for adjusting the power, a voltmeter (5) that measures the voltage across the lamp (9), voltage comparator means (6) that compares the measured voltage with a threshold, supply interruption means (7) that interrupts the power supply to the lamp (9) if the measured voltage exceeds the threshold during a defined delay time, characterized in that the ballast (1) also comprises adjusting means (4) that adjusts the magnitude of the threshold in dependence on the power.

2. The ballast as claimed in claim 1, characterized in that the adjusting means (4) adjusts the magnitude of the threshold in dependence on the power adjusted by the dimming means (3).

3. The ballast as claimed in claim 1, characterized in that the adjusting means (4) are connected to a power meter which measures the power through the lamp (9), the adjusting means (4) adjusting the magnitude of the threshold in dependence on the measured power.

4. The ballast as claimed in claim 1, characterized in that the adjusting means (4) are connected to a temperature sensor, and the adjusting means (4) adjusts the magnitude of the threshold in dependence on the measured temperature.

5. The ballast as claimed in claim 4, characterized in that the temperature sensor measures the ambient temperature.

6. The ballast as claimed in claim 1, characterized in that the adjusting means (4) adjusts the magnitude of the threshold in dependence on the type of fluorescent lamp (9) fed by the ballast (1).

7. The ballast as claimed in claim 1, characterized in that the adjusting means (4) also comprise storage means in which combinations of powers and thresholds are stored.

8. The ballast as claimed in claim 1, characterized in that the delay time is determined in dependence on the power.

9. The ballast as claimed in claim 1, characterized in that the delay time is determined in dependence of the type of fluorescent lamp (9) fed by the ballast (1).

10. A method of feeding a fluorescent lamp (9), wherein the power adjusted by the dimming means (3) is supplied to the lamp (9), the voltage across the lamp (9) is measured, whereby the measured voltage is compared with a threshold, and the power supply to the lamp (9) is interrupted if the measured voltage exceeds the threshold for a defined delay time, characterized in that the magnitude of the threshold is adjusted in dependence on the power.

11. A ballast for feeding a fluorescent lamp and for reducing power to the lamp at the end of the life of the lamp as indicated by abnormal voltages, said ballast comprising:

a converter for producing high voltage DC from power line voltage;

an inverter having an input coupled to said converter and an output for coupling to said lamp, said inverter producing high frequency alternating current from said high voltage DC;

a microprocessor coupled to said converter and said inverter for controlling the operation of said lamp;

said microprocessor being programmed to reduce power to the lamp for dimming;

measure the voltage across the lamp, compare the voltage with a threshold;

interrupt power to the lamp when the measured voltage exceeds a threshold;

delay said interruption for a predetermined time during which said threshold must be exceeded; and adjust the threshold in accordance with the power supplied to the lamp during normal operation, including dimming.

* * * * *